United States Patent [19]

Bergin

[11] 4,083,210

[45] Apr. 11, 1978

[54] CYLINDER LOCK MECHANISM

[76] Inventor: Paul F. Bergin, 1335 Prospect Dr., Mishawaka, Ind. 46544

[21] Appl. No.: 761,549

[22] Filed: Jan. 21, 1977

[51] Int. Cl.[2] ..... E05B 27/00

[52] U.S. Cl. ..... 70/362; 70/364 A; 70/421

[58] Field of Search ..... 70/358, 362, 364 R, 70/364 A, 373, 375, 416, 419, 421

[56] References Cited

U.S. PATENT DOCUMENTS

| | | | |
|---|---|---|---|
| 1,835,725 | 12/1931 | Thompson | 70/421 |
| 1,906,701 | 5/1933 | Maxwell | 70/421 |
| 2,022,070 | 11/1935 | Williams | 70/421 |
| 3,418,833 | 12/1968 | Kerr | 70/421 |

*Primary Examiner*—Robert L. Wolfe

[57] ABSTRACT

A lock which includes a barrel member for mounting to a lockable article, such as a door, and which carries a rotatable plug. The plug includes spring biased tumblers. A key is inserted into the plug and engages the tumblers to release the plug for rotation relative to the barrel member, with one of the tumblers interlocking with the key to prevent its removal from the plug when the plug is rotated to an unlocked position.

7 Claims, 11 Drawing Figures

Fig.3
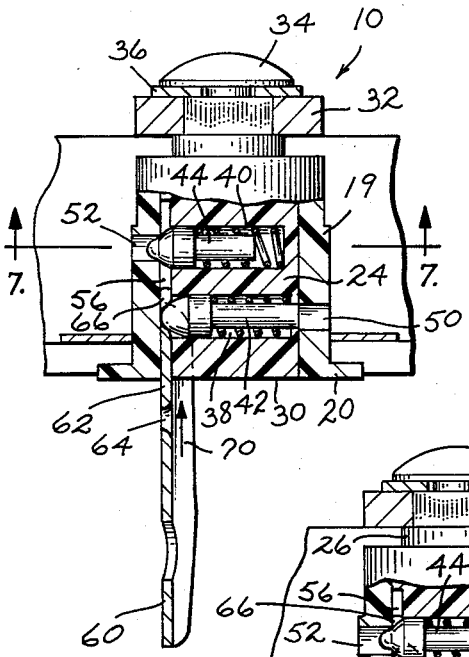
Fig.6
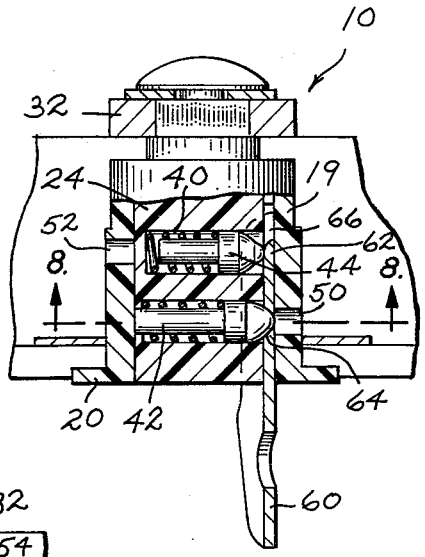
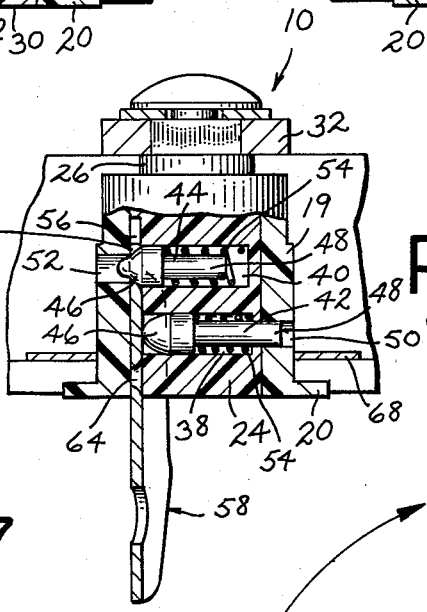
Fig.4
Fig.7
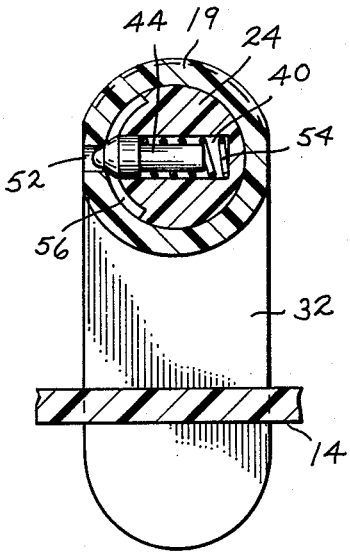
Fig.8
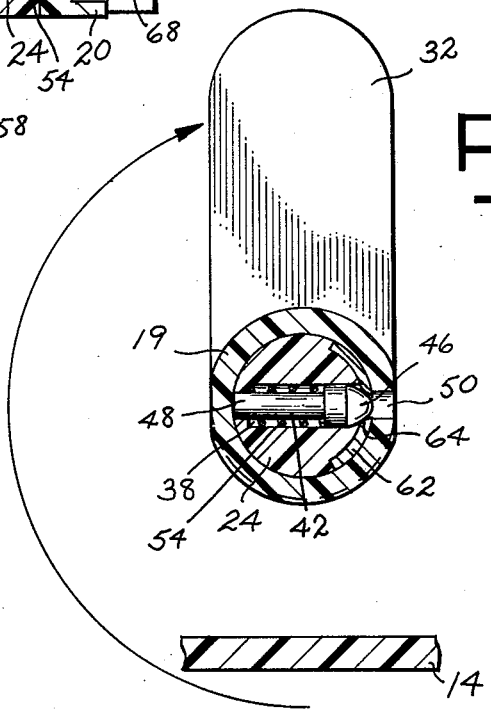

CYLINDER LOCK MECHANISM

SUMMARY OF THE INVENTION

This invention relates to a lock mechanism and will have particular application to a cylinder type lock.

The lock of this invention is provided with a barrel member for mounting to a lockable article, such as a door. Fitted within the barrel member is a rotatable plug which carries an actuator means for releasing and securing the lock upon rotation of the plug within the barrel member between locked and unlocked positions. A pair of tumblers are carried within the plug with at least one of the tumblers being engageable with the barrel member to secure the plug in its locked position against rotation. A key is inserted into a key slot in the plug and causes the tumblers to be shifted to release the plug for rotation within the barrel member into its unlocked position. At least one of the tumblers engages the key in such a manner to prevent the key's removal when the plug is rotated into its unlocked position. Additionally, the tumblers are so aligned within the plug that should an attempt be made to pick or force the lock open without the key by the insertion of a probe into the key slot one of the tumblers will interlock with the barrel member to prevent rotation of the plug.

It is an object of this invention to provide a lock mechanism which is of simplified but reliable structural form.

Another object of this invention is to provide a cylinder type lock in which the key which is utilized to unlock the lock cannot be withdrawn from the lock mechanism when the lock is open.

And still another object of this invention is to provide a cylinder lock having a cooperating tumbler mechanism which hinders picking or otherwise opening the lock without the use of a key.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 3 is a fragmentary sectional view of the lock shown secured with a key being inserted into the lock.

FIG. 4 is a fragmentary sectional view like FIG. 3 showing the key partially inserted into the lock.

FIG. 6 is a fragmentary sectional view of the lock like FIG. 3 showing the lock open.

FIG. 7 is a cross sectional view taken along line 7—7 of FIG. 3.

FIG. 8 is a cross sectional view taken along line 8—8 of FIG. 6.

DESCRIPTION OF THE PREFERRED EMBODIMENT

The preferred embodiment illustrated is not intended to be exhaustive or to limit the invention to the precise form disclosed. It is chosen and described in order to best explain the invention and its application and practical use to thereby enable others skilled in the art to best utilize the invention.

Figure 1:
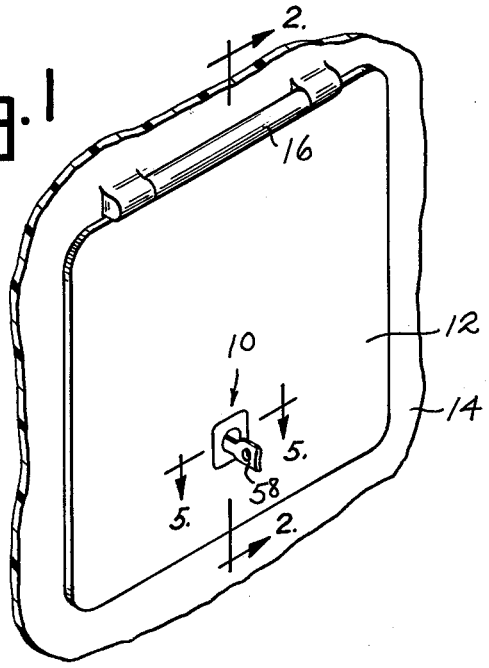
FIG. 1 is a perspective view showing the lock of this invention mounted to a hatch cover.

Lock 10 is shown in FIG. 1 as being connected to a door 12 which covers an opening in a frame 14. Door 12 is connected along one side edge by a hinge 16 to frame 14.

Lock 10 includes a barrel member 18 having a side wall 19. Barrel member 18 terminates at its outer end in a outturned flange 20 and at its inner end in an in-turned flange 22. A plug 24 is fitted rotatably within barrel member 18. One end of plug 24 is formed into a neck 26 which projects past the in-turned flange 22 of barrel member 18. Plug 24 includes a shoulder 28 which abuts in-turned flange 22 of barrel member 18 with the front end face 30 of the plug being positioned generally flush with outturned flange 20 of the barrel member. A cam part 32 is connected to neck 26 of plug 24 and is retained by means of a screw 34 and accommodating lock washer 36. Cam part 32 engages frame 14 upon plug rotation within barrel member 18 to secure door 12 in its closed position. In other applications of this invention, other types of cam or actuator parts could be used to secure the lock.

Plug 24 includes a pair of transversely oriented bores 38 and 40 which intersect the rotational axis of the plug. Bores 38 and 40 parallel one another, with bore 38 being located nearer end face 30 of the plug than bore 40. Bore 38 extends entirely through plug 24 while bore 40 preferably terminates within the plug. A tumbler 42 is slidably housed within bore 38 and a tumbler 44 is slidably housed within bore 40. Each tumbler 42 and 44 includes an enlarged head 46 and a shank 48. The length of tumbler 42 exceeds the length of bore 38. The length of tumbler 44 is less than the length of its receiving bore 40 to enable the tumbler to be entirely recessed within its bore.

Figure 5:
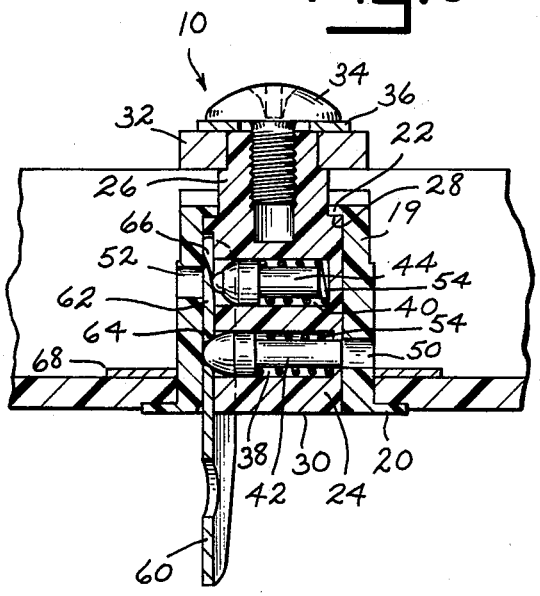
FIG. 5 is a sectional view taken along line 5—5 of FIG. 1 showing the key fully inserted into the lock mechanism with the lock secured.
Figure 10:
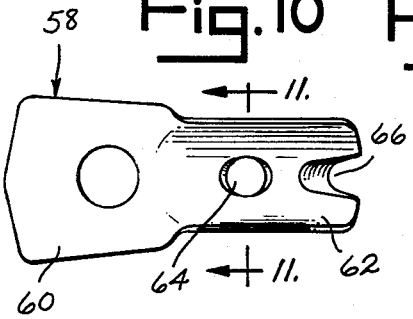
FIG. 10 is a view of the key as seen along line 10—10 of FIG. 9.
Figure 11:
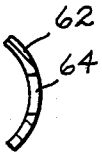
FIG. 11 is a cross sectional view of the key taken along line 11—11 of FIG. 10.
Figure 9:
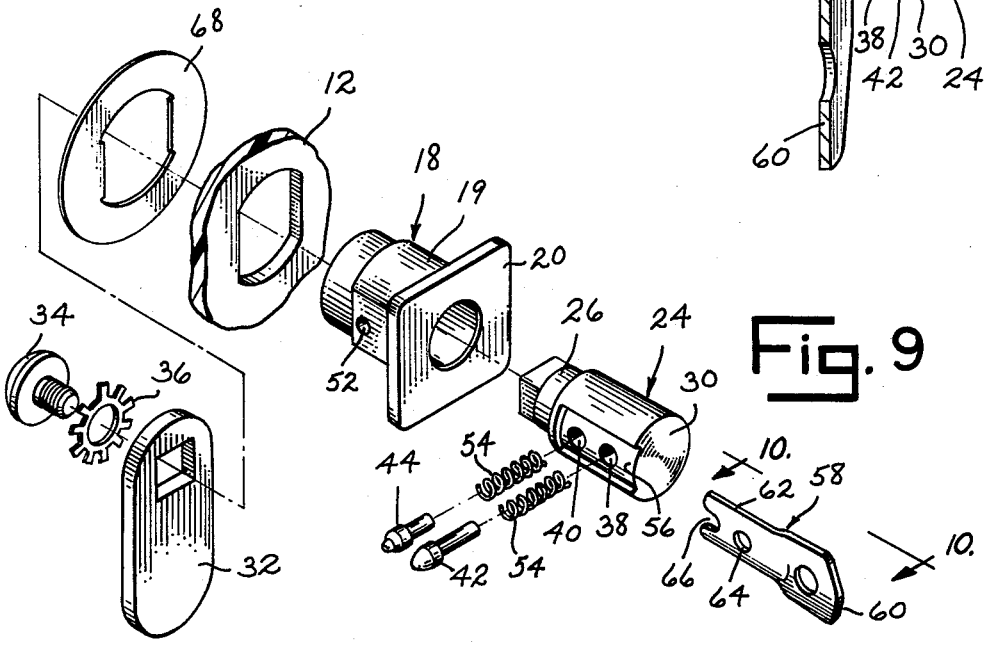
FIG. 9 is an exploded view of the component parts of the lock.

Side wall 19 of barrel member 18 is interrupted at its inner surface by a pair of recesses, shown to be openings 50 and 52 in the preferred embodiment. Openings 50 and 52 extend through side wall 19 and are located so that opening 50 is aligned with bore 38 at the shank end of tumbler 42 and opening 52 is aligned with bore 40 at the head end of tumbler 44 when plug 24 is in its locked position, as shown in FIGS. 3, 4 and 5. A helical spring 54 surrounds each tumbler shank 48 and is compressed between head 46 of the tumbler and a part of plug 24 so as to urge the tumblers into protruding positions in contact with side wall 19 of barrel member as shown in FIG. 3. With plug 24 in its locked position, head 46 of tumbler 44 extends into opening 52 in the barrel member to secure the plug against rotative movement relative to the barrel member, and head 46 of tumbler 42 will contact the inner surface of barrel member side wall 19 with its shank 48 extending just to opening 50 in the side wall.

The outer surface of plug 24 is recessed at the location of heads 46 of tumblers 42 and 44 so as to form an arcuate key slot 56. A key 58 is provided to rotate plug 24 between its locked and unlocked positions. Key 58 includes a grip part 60 and a web part 62. Web part 62 is arcuate in cross section and is shaped and sized to fit complementally within key slot 56 next to barrel member side wall 19. Web part 62 of key 58 includes a center opening 64 and a notched opening 66 formed on a bevel at the end of the web part.

Lock 10 is mounted to door 12 by being inserted through an opening in the door with its flange 20 abutting the outside surface of the door. An annular retainer clip 68 is force fitted over the barrel member and pressed against the inside surface of the door. This method of securing the lock to door 12 is most advantageous when barrel member 18 and plug 24 of the lock are formed of a molded plastic material. It is to be understood that in other applications barrel member 18 could be bonded to the door by an adhesive or threaded to accommodate a nut which is turned onto the barrel member and brought to bear against the door. In those embodiments of the lock 10 in which the barrel member and plug 24 are formed of a metallic composition, the barrel member could also be welded or similarly bonded to the door.

Figure 2:
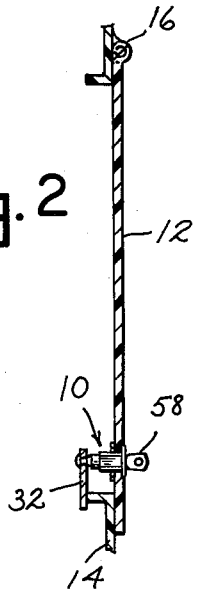
FIG. 2 is a sectional view taken along line 2—2 of FIG. 1.

With lock 10 secured to door 12, cam part 32 connected to plug 24 is located behind frame 14 when the plug 24 is located in its locked position, as shown in FIG. 2, to secure the door in its closed position. With plug 24 in its locked position and key 58 removed from key slot 56, any bladed instrument or pick inserted into the key slot in an attempt to manipulate tumbler 44 from opening 52 would first contact tumbler 42 and cause it to be urged rearwardly into its bore 38 with shank end 48 of the tumbler protruding into recess 50 such as illustrated in FIG. 4 to prevent rotation of the plug within the barrel member 18.

To utilize key 58 to rotate plug 24 between its locked and unlocked positions, the key is first inserted into key slot 56 in the direction of arrow 70 in FIG. 3. The beveled edge of notch 66 in the key first contacts tumbler 42 urging it rearwardly with its shank 48 protruding into opening 50, as seen in FIG. 4. Continued insertion of key 58 into slot 56 causes the beveled edge of notch 66 to contact tumbler 44 urging the tumbler into its recessed position within its bore 40 and out of opening 52, with tumbler 42 seating within opening 64 in the key, free of bore 50, as seen in FIG. 5. With key 58 fully inserted into slot 56 as shown in FIG. 5, plug 24 can be rotated, by a turning of key 58, into its unlocked position, as shown in FIGS. 6 and 8. This movement of plug 24 frees cam part 32 from contact with frame 14 and permits door 12 to be opened with key 58 serving as a handle for the door. As will be observed in FIGS. 6 and 8, head 46 of tumbler 42 projects into central opening 64 in key 58 with shank 48 of the tumbler being located next to an uninterrupted part of side wall 19 of barrel member 18 to prevent the removal of the key from slot 56. Thus any time plug 24 is rotated by key 58 so as to place tumbler 42 out of alignment with opening 50, the key will be prevented from being withdrawn from the key slot. When plug 24 is again rotated by key 58 into its lock position aligning tumblers 42 and 44 with openings 50 and 52, the key may be pulled from key slot 56 to allow head 46 of tumbler 44 to enter opening 52 after momentarily camming tumbler 42 into opening 50.

It is to be understood that the invention is not to be limited to the details above given, but that it may be modified within the scope of the appended claims.

What I claim is:

1. A lock comprising a barrel member for mounting to a lockable article, said barrel member including a side wall terminating in opposite inner and outer ends and defining a cavity in the barrel member, a plug fitted rotatably within said barrel member cavity, said barrel member outer end being open to permit access to said plug, said plug including a cylindrical outer surface and carrying actuator means for securing and releasing the lock upon rotation of the plug within the barrel member between locked and unlocked positions, said barrel member side wall having a cylindrical inner surface juxtaposed with said plug outer surface, a recess formed in said barrel member inner surface, first and second shiftable tumblers carried by said plug, said first tumbler aligned with said recess when said plug is in its locked position, biasing means urging said first tumbler into securing engagement in said recess with said plug to prevent plug rotation when said plug is in its locked position, biasing means urging said second tumbler into a first position, means permitting said second tumbler to be shifted from said first position into a second position when said plug is in its locked position only, said plug having a key receiving groove formed in its outer surface extending to said tumblers, said groove conforming to the cylindrical outer surface of said plug and forming a slot in association with said barrel member inner surface, key means for insertion into said slot between said barrel member and plug to cause rotation of said plug, said key means including surface means for engaging said tumblers and urging said first tumbler out of said recess and said second tumbler toward its second position as said key means is inserted into said slot with said plug in its locked position, said key means fitted removably in said slot with said plug in its locked position and camming said first tumbler out of said recess with said second tumbler engaging said key means in its said first position to enable said plug to be rotated into its unlocked position, said key means fitting unremovably within said slot with said plug in its unlocked position and with said second tumbler lockingly engaging said key means in its first position to prevent removal of said key means from said slot.

2. The lock of claim 1 wherein said barrel member side wall inner surface has a second recess formed therein, said second recess aligned with said second tumbler when said plug is in its locked position to accommodate movement of said second tumbler as it is shifted from its first into its second position.

3. The lock of claim 2 wherein said first mentioned and second recesses are located on opposite sides of said barrel member side wall with said second recess being positioned nearer to said barrel member outer end than said first mentioned recess, said second tumbler positioned nearer to said barrel member outer end than said first tumbler.

4. The lock of claim 3 wherein said plug has two transverse bores formed therein, one of said bores extending through said plug and being alignable with said second recess when said plug is in its locked position, said second tumbler is slidably received within said one bore, the other bore being alignable with said first recess when said plug is in its locked position, said first tumbler slidably received within said other bore, said second tumbler exceeding the length of said one bore wherein said second tumbler will protrude from said plug when in either its first or second positions, one end of said second tumbler protruding from said plug and engaging said key means and the other end of said second tumbler terminating within said plug out of said second recess when said plug is in its locked position with said key means fitted in said slot, said second recess accommodating said second tumbler other end as said second tumbler shifts toward its second position during key means insertion into said slot.

5. The lock of claim 4 wherein each of said first and second tumblers has one end protruding into said slot and the other end of said second tumbler extends to said second recess when said plug is in its locked position with said key means removed, said second tumbler one end constituting obstruction means in said slot for preventing access to said first tumbler through said slot from said barrel member outer end unless shifted into its second position with its said other end protruding into said second recess to prevent plug rotation.

6. The lock of claim 4 wherein said key means includes a grip part and a web part, said web part terminating in a beveled end edge means for first camming said second tumbler into its second position and then camming said first tumbler out of said first recess as said key means is being fitted into said slot, said web part including recess means located between said end edge means and grip part for receiving said second tumbler in its first position when said key means is fitted into said slot and for camming said second tumbler toward its said second position as said key means is being removed from said slot, said end edge means and recess means constituting said surface means for said key means.

7. The lock of claim 2 wherein said key means constitutes handle means when said key means is fitted into said slot and said plug means is rotated to its unlocked position for moving a part of said lockable article.

* * * * *